US006729295B2

(12) United States Patent
Tomczyk

(10) Patent No.: US 6,729,295 B2
(45) Date of Patent: May 4, 2004

(54) ROTARY PISTON ENGINE

(75) Inventor: Hubert Tomczyk, Düsseldorf (DE)

(73) Assignee: DIRO Konstruktions GmbH & Co. KG, Ruhen-Brechtorf (DE)

( * ) Notice: Subject to any disclaimer, the term of this patent is extended or adjusted under 35 U.S.C. 154(b) by 0 days.

(21) Appl. No.: 10/239,887

(22) PCT Filed: Jan. 11, 2001

(86) PCT No.: PCT/DE01/00083

§ 371 (c)(1),
(2), (4) Date: Dec. 27, 2002

(87) PCT Pub. No.: WO01/77498

PCT Pub. Date: Oct. 18, 2001

(65) Prior Publication Data

US 2003/0111040 A1 Jun. 19, 2003

(30) Foreign Application Priority Data

Mar. 28, 2000 (DE) ..... 100 15 388

(51) Int. Cl.[7] ..... I02B 53/04
(52) U.S. Cl. ..... 123/221; 123/235; 418/195
(58) Field of Search ..... 123/221, 235; 418/195, 207

(56) References Cited

U.S. PATENT DOCUMENTS

| | | | | |
|---|---|---|---|---|
| 2,674,982 A | | 4/1954 | McCall | 123/221 |
| 3,751,193 A | * | 8/1973 | McCall | 418/195 |
| 3,802,814 A | | 4/1974 | Babcock | |
| 3,809,022 A | * | 5/1974 | Dean, Jr. | 123/221 |
| 3,841,276 A | * | 10/1974 | Case | 123/221 |
| 3,862,623 A | | 1/1975 | Ehlert | 123/235 |
| 4,005,682 A | * | 2/1977 | McCall et al. | 123/221 |
| 5,233,954 A | * | 8/1993 | Chomyszak | 123/221 |

FOREIGN PATENT DOCUMENTS

| | | | | |
|---|---|---|---|---|
| AU | 077031247 A | * | 6/1979 | 123/221 |
| DE | 227054 | | 4/1963 | |
| DE | 2 034 300 | | 4/1971 | |
| DE | 2104 595 | | 8/1972 | |
| DE | 2655649 A1 | | 6/1978 | |
| DE | 27 31 534 C3 | | 5/1980 | |
| DE | EP 0 091 975 A1 | | 10/1983 | 123/221 |
| DE | 33 17 089 A1 | | 11/1984 | |
| DE | 33 21 461 C2 | | 5/1987 | |
| DE | 260 704 | | 10/1988 | |
| DE | 33 17 330 C2 | | 2/1993 | |
| FR | 928208 | | 5/1946 | |
| GB | 17535 | | 7/1910 | |
| WO | WO91/0215 | | 2/1991 | 123/221 |

* cited by examiner

*Primary Examiner*—Thomas Denion
*Assistant Examiner*—Thai Ba Trieu
(74) *Attorney, Agent, or Firm*—Whitham, Curtis & Christofferson, P.C.

(57) ABSTRACT

A rotary piston engine having at least two rotary pistons formed as gearwheels mounted in a rotatable fashion on mutually perpendicular axes in a housing that provides a closed seal for the pistons on both faces as well as around their circumferences, is at one point in a sliding, mutually sealing engagement of gear, teeth with each other. The two rotary pistons have different diameters and the teeth forming the individual pistons make contact at an angle of 45° in each case and have slightly helical flanks. The tooth spaces forming a carburetion chamber, a compression chamber and a working chamber have an inside contour precisely matching the shape of the teeth. Each of the internal and external teeth are assigned through-flow bores where each through-flow bores opens into an outlet on a circular surface area of the rotary pistons which lie opposite to each other.

7 Claims, 11 Drawing Sheets

ROTARY PISTON ENGINE

BACKGROUND OF THE INVENTION

The invention relates to a rotary piston engine having at least two rotary pistons, both being formed as gearwheels mounted in a rotatable fashion on mutually perpendicular axes in a housing providing a closed seal for the pistons on both faces as well as around their circumferences, and being at one point in a sliding, mutually sealing engagement of gear teeth with each other.

Reference is made to DE 33 17 089 A1, DE 33 17 330 C2, DE 27 31 534 C3, DE 33 21 461 C2, DT 2 104 595, DE 26 55 649 A1, DT 2 034 300, DE 260 704, EP 0 091 975 A1 as well as DE 227 054 and GB 17,535 with general regard to the prior art.

Most of these already disclosed proposals are based on a design having two meshing piston rings, the axes of which intersect in the middle of the piston ring, as a result of which the two piston rings have the same midpoint, or alternatively a design having two piston rings, the pistons of which are only formed on the outer surface of the ring. In embodiments in which a piston ring rotates in the inner chamber of a second piston ring, although the spherical sealing surfaces are the same for both piston rings, the sealing in direction of rotation is not ensured in one of two points of intersection. Sealing in the direction of rotation is also not ensured in the second of the aforementioned embodiments; further disadvantages are also presented by the dimensions and weight of such an engine.

All of the already disclosed solutions are based on the familiar system of the carburetion of a combustible mixture followed by a subsequent combustion process. Resulting disadvantageously from the design of the system, there is a very short time available for carburetion of the combustible mixture and its subsequent combustion. Additional disadvantages arise from the valve timing control systems usually required.

Disadvantages are presented by an incomplete combustion of fuel and the associated generation of harmful exhaust gases. For the purpose of extending the time available for carburetion and combustion of the fuel mixture, the air and fuel are often mixed in a carburetor, i.e. a long distance ahead of the combustion chamber, or, in the case of fuel injection systems, in the intake port.

The solutions disclosed thus far have favored the use of the largest possible size of combustion chamber, which does however incur disadvantages resulting from the design of the system. The present invention is therefore based on the assumption that very low capacity engines offer the best efficiency ratios and enable better conditions for combustion to be achieved.

SUMMARY OF THE INVENTION

The object of the present invention was therefore to develop a rotary piston engine displaying the advantages of a very low capacity engine, i.e. enabling near-complete fuel combustion and minimizing emissions of harmful exhaust gases.

Based on the rotary piston engine described above, this object is achieved, according to the invention, by means of the following features:

a) the at least two rotary pistons have different diameters;

b) the internal teeth and external teeth of the at least two rotary pistons contact at an angle of 45° in each case and have slightly helical flanks;

c) tooth spaces, forming a carburetion chamber, a compression chamber and a working chamber, have an inside contour precisely matching the shape of the teeth;

d) each of the internal teeth and external teeth of the at least two rotary pistons is assigned each of throughflow bores, wherein the latter forming a combustion chamber and being incorporated in the rotary piston, wherein said each of the throughflow bores opens into an outlet on the circular surface areas of the at least two rotary pistons which lie opposite to each other, wherein a closed seal being provided through certain angles of rotation for the bore at points opposing to housing walls which enclose one of the at least two rotary pistons in a sandwich arrangement;

e) ahead of the point in a sliding, mutually sealing engagement of gear teeth, lies a first connecting duct for each of the at least two rotary pistons in the aforementioned housing walls. This duct provides a flow connection between the tooth space rotating past it and a throughflow bore and filles the latter with compressed air or a fuel mixture;

f) behind the point in a sliding, mutually sealing engagement of gear teeth, lies a second connecting duct for each of the at least two rotary pistons in the aforementioned housing walls, wherein the second connecting duct provides a flow connection between the throughflow bores rotating past the second connecting duct and one of the subsequent tooth spaces, into which the charge in said each of the throughflow bores expands;

g) the aforementioned housing walls incorporate exhaust opening both before and after the point in a sliding, mutually sealing engagement of gear teeth as well as intake openings lying opposite to the exhaust openings, wherein the intake openings are connected to an air intake or a fuel mixture intake, wherein the intake openings are flow-connected in sequence to the tooth spaces passing by.

According to the invention, therefore, the carburetion process is isolated in time and space from the standard processes encountered in conventional internal combustion engines in that a separate "carburetion cycle" is created. This is achieved by an arrangement of sequentially operating combustion chambers in a rotary piston. During a compression cycle in a tooth space the compressed medium is pressed into a combustion chamber which is also incorporated in the rotary piston and subsequently remains closed for the aforementioned "carburetion cycle". The pressure required for the subsequent work cycle is generated by the forward combustion chamber in the rotary piston, in which the entire carburetion process and the combustion process have just been completed. The combustion chambers incorporated in the rotary piston are linked in sequence via ducts formed in the engine housing to working volumes formed by the tooth spaces.

According to the invention, a large number of very small combustion chambers are therefore created, and at the same time sufficient time and space is provided for carburetion and combustion of the combustible mixture. This improves the energy yield and reduces emissions of harmful pollutants. In terms of design, it is also advantageous that the rotary piston engine according to the invention does not require a crankshaft, connecting rods or valves.

Any type of fuel is suitable for operation of the rotary piston engine according to the invention, in particular hydrogen or alcohol, or fuel mixtures, such as naphtha with water. Here it is advantageous if the throughflow bores forming the combustion chambers are equipped with catalysts or inserts for flameless combustion. When using hydrogen, water injection can be utilized, whereas a nickel insert is suitable for a naphtha/water mixture.

The rotary piston engine according to the invention is not only suitable for use in airplane engines, ship engines and automotive engines, but also in electricity generators.

For formation of the individual cycle sequences it is useful if the intake opening overlaps the opposing exhaust opening for a partial angle of rotation. It is also advantageous if the intake opening extends across an angular width of more than one tooth space.

In order to extend the service life, it is advantageous if the throughflow bores forming the combustion chambers and possibly also the secondary connecting ducts are coated with a layer of heat insulating material.

Further advantages of the invention are explained in greater detail by means of an exemplary embodiment.

BRIEF DESCRIPTION OF THE DRAWINGS

The drawing shows an illustration of an exemplary embodiment of the invention, in which.

DESCRIPTION OF THE PREFERRED EMBODIMENTS

Figure 1:
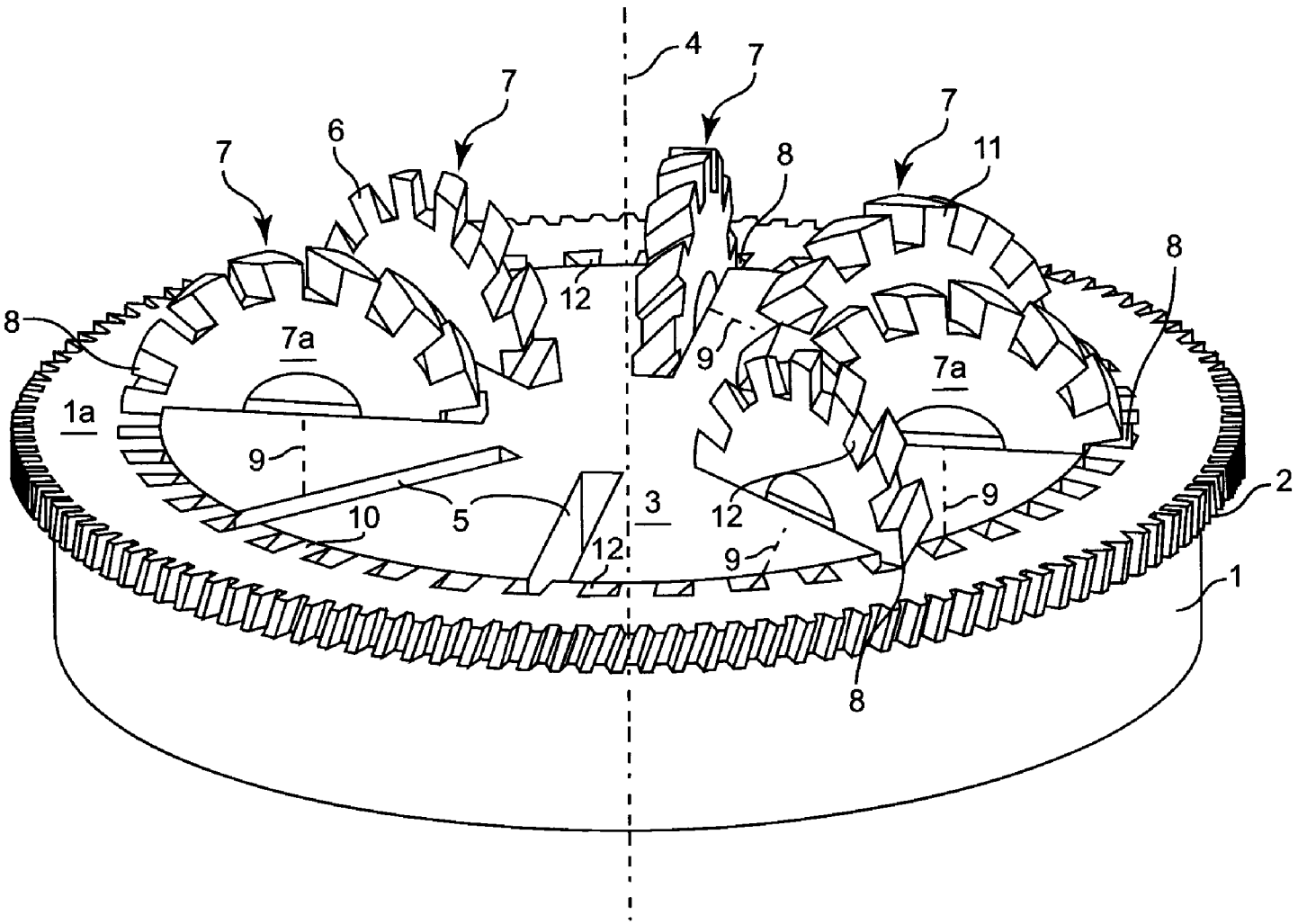
FIG. 1 shows a schematic and perspective illustration of an internal ring gear 1 forming the output of a rotary piston engine, which encloses several rotary pistons, each having external toothing and being of a smaller diameter and all of which are mounted in an engine housing which is only partially indicated in the drawing here.

FIG. 1 shows a schematic representation of the rotating parts of an internal combustion rotary piston engine, in which the housing cover is omitted from the drawing.

The output from the engine is taken from a rotary piston formed as an internal ring gear 1, the latter also having an external toothing 2 for the transfer of torque to a transmission connected after the engine and not illustrated in any more detail in the drawing. The internal ring gear 1 is mounted in a fashion which permits rotation around an axis 4 in a housing section 3, the latter only being indicated schematically in the drawing. Cutouts 5 are present in this housing section 3, one rotary piston 7 with external toothing 6 being inserted in each of the former, and each of the rotary pistons 7 having a smaller diameter than the internal ring gear 1, with all of the rotary pistons being in engagement 8 with the internal ring gear 1 and having their axes of rotation 9 lying in the diametrically symmetrical plane formed approximately by the illustrated housing section 3. Each of these axes of rotation 9 therefore lies perpendicular to axis 4 of internal ring gear 1.

The internal teeth 10 of internal ring gear 1 and the external teeth 11 of the rotary pistons 7 contact each other at an angle of 45°, having slightly helical flanks and forming in each case individual pistons which, under rotation of the rotary pistons 1, 7, slide into the tooth spaces 12 of the corresponding rotary piston in each case, the former having an inside contour precisely matching the form of the internal and external teeth 10, 11 and forming carburetion chambers or compression chambers. The tooth flanks are formed to be straight along their radial height, but are formed slightly helically in the axial direction.

Figure 10:
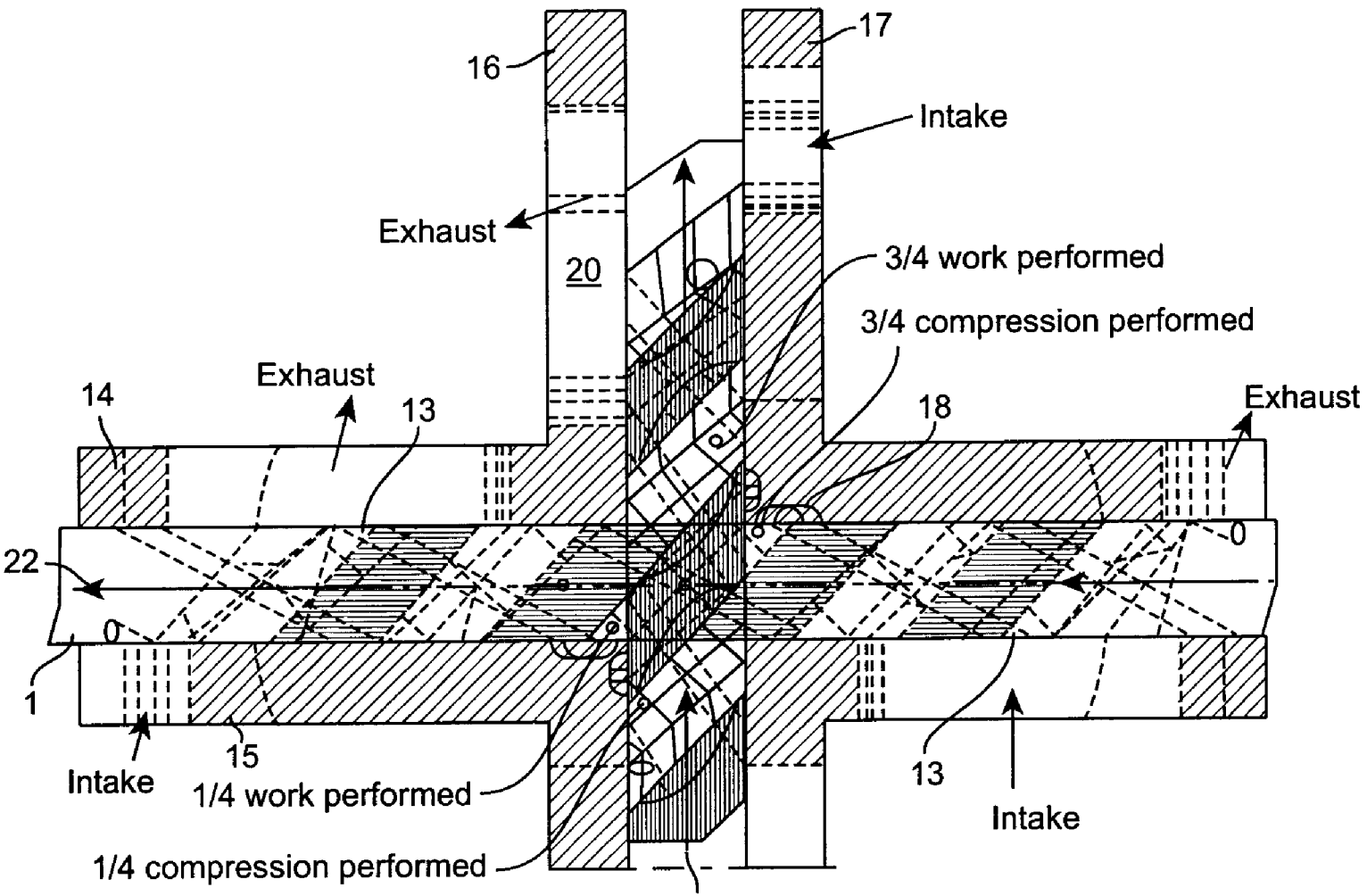
Figure 11:
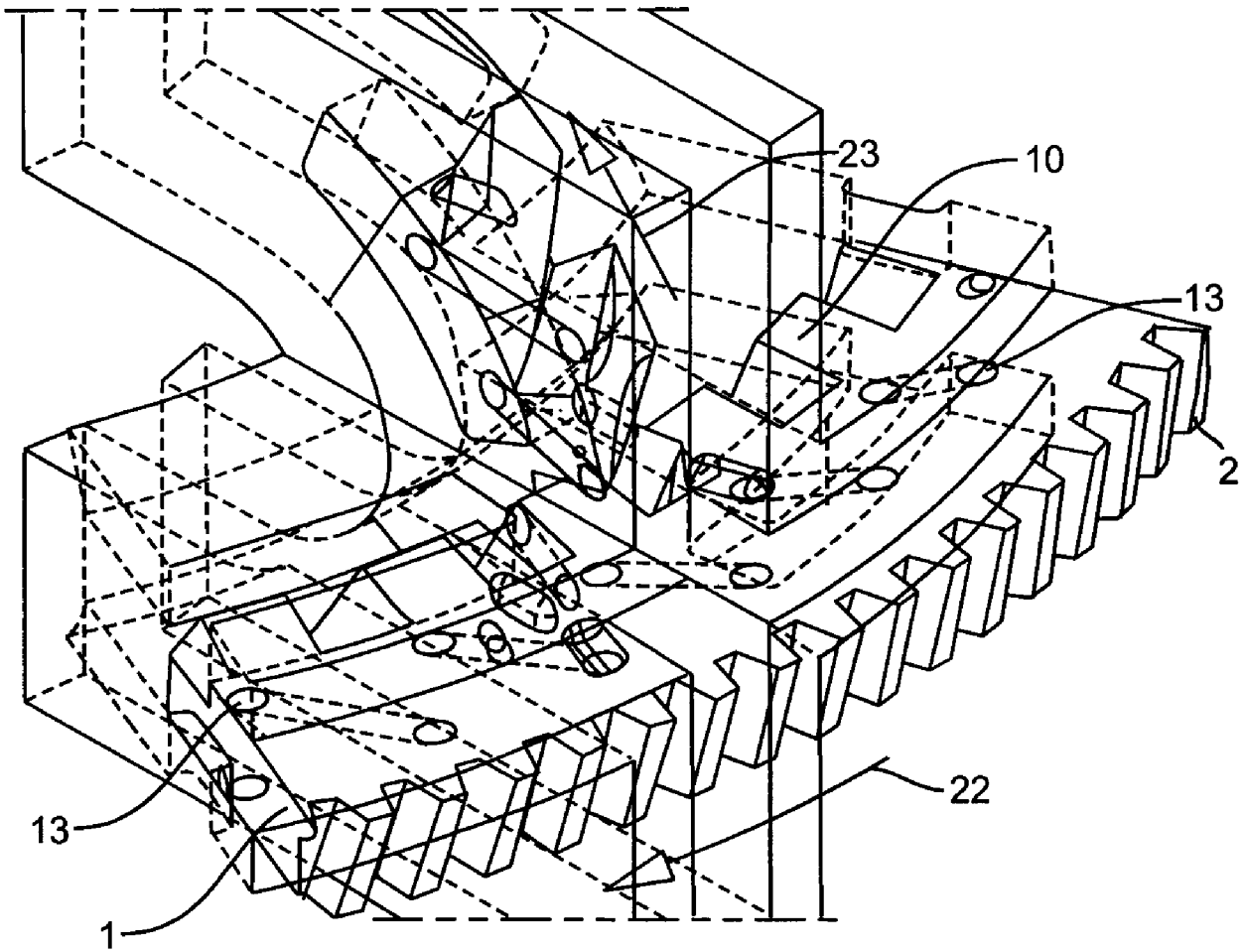

Each tooth 10, 11 is assigned a throughflow bore 13, the latter forming a combustion chamber and being incorporated in the rotary piston 1, 7. This throughflow bore 13 opens into an outlet on the circular surface areas 1*a*, 7*a* of the rotary piston which lie opposite each other, a closed seal being provided through certain angles of rotation for the bore at these points by means of opposing walls 14, 15 or 16, 17 of the housing which enclose one rotary piston 1, 7 in a sandwich arrangement (see e.g. FIG. 2). In the embodiment shown in FIGS. 10 and 11, this embodiment only being modified in terms of the routing of the throughflow bore 13, the diagonally routed throughflow bore 13 links a tooth space 12 with the respective second following tooth space.

Ahead of each tooth engagement point 8 a first connecting duct 18 is incorporated in the housing walls 14, 16 for each of the rotary pistons 1, 7 illustrated in FIGS. 2 to 9. Each duct provides a flow connection between the tooth space 12 rotating past it and throughflow bore 13 and fills the latter with compressed air or fuel mixture. Behind the tooth engagement point 8 a second connecting duct 19 is incorporated in the housing walls 15, 17 for each of the two rotary pistons 1, 7. This duct provides a flow connection between the throughflow bore 13 rotating past it and one of the subsequent tooth spaces 12, into which the charge in the throughflow bore 13 expands.

The housing walls 14, 16 incorporate exhaust openings 20 both before and after the tooth engagement point 8 illustrated as well as intake openings 21 in the housing walls 15, 17, the intake openings 21 being connected to an air intake or a fuel mixture intake (not illustrated in any more detail in the drawing) and lying opposite the respective exhaust openings in such a way that the exhaust opening 20 and the corresponding intake opening 21 are flow-connected in sequence to the corresponding tooth space 12 passing by. Here, the intake opening 21 can only overlap the opposite-lying exhaust opening 20 through a partial angle of rotation a. The intake opening 21 extends over the angle width b of two successive tooth spaces 12.

In FIGS. 2 to 9 the arrows 22 indicate the direction of rotation of the internal ring gear 1, and the arrows 23 indicate the direction of rotation of the rotary piston 7 illustrated in these figures in the area of the illustrated tooth engagement point 8.

Figure 2:
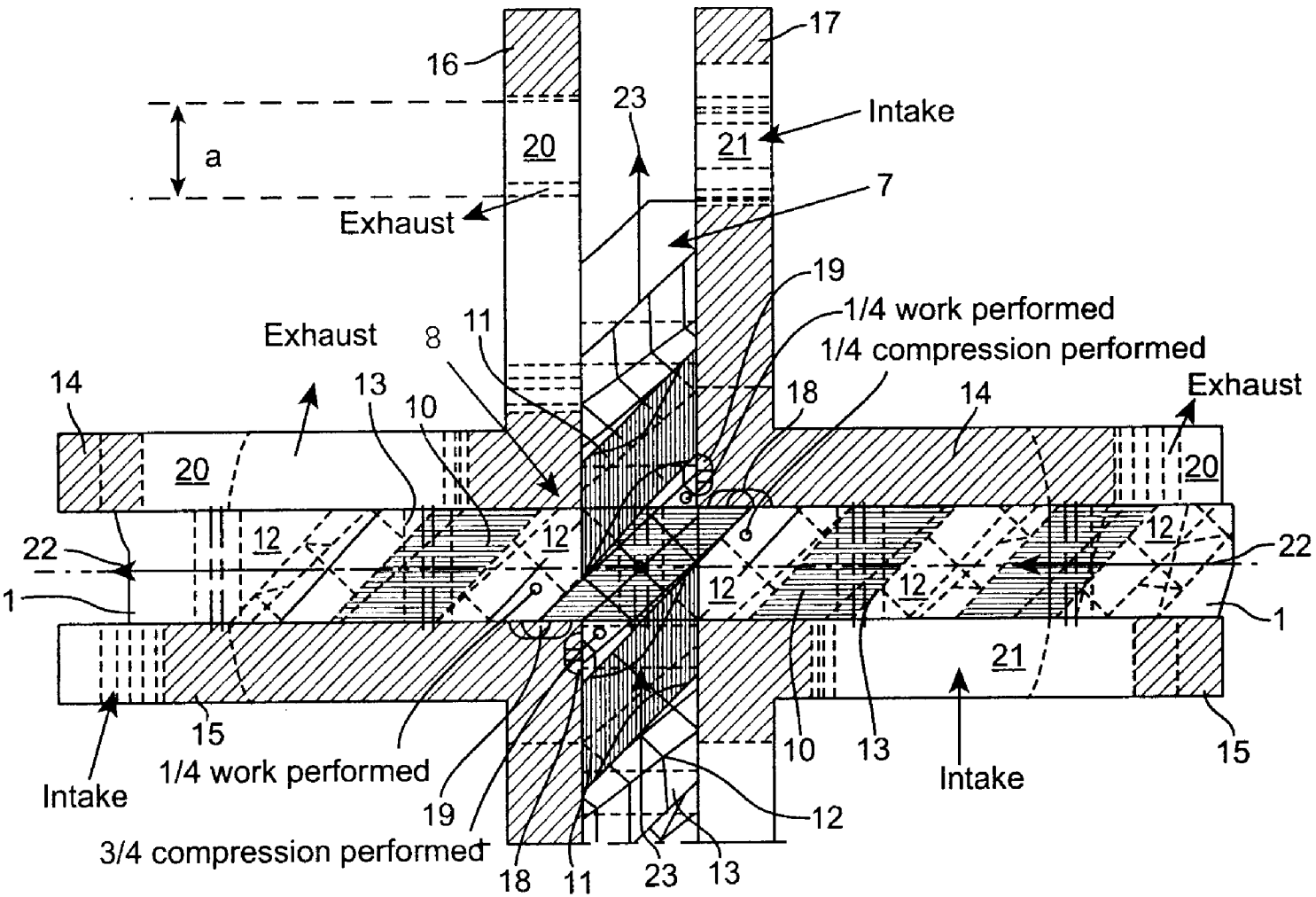
FIG. 2 shows an internal view, partially in section, of the area of tooth engagement between the internal ring gear and one rotary piston having external toothing.
Figure 3:
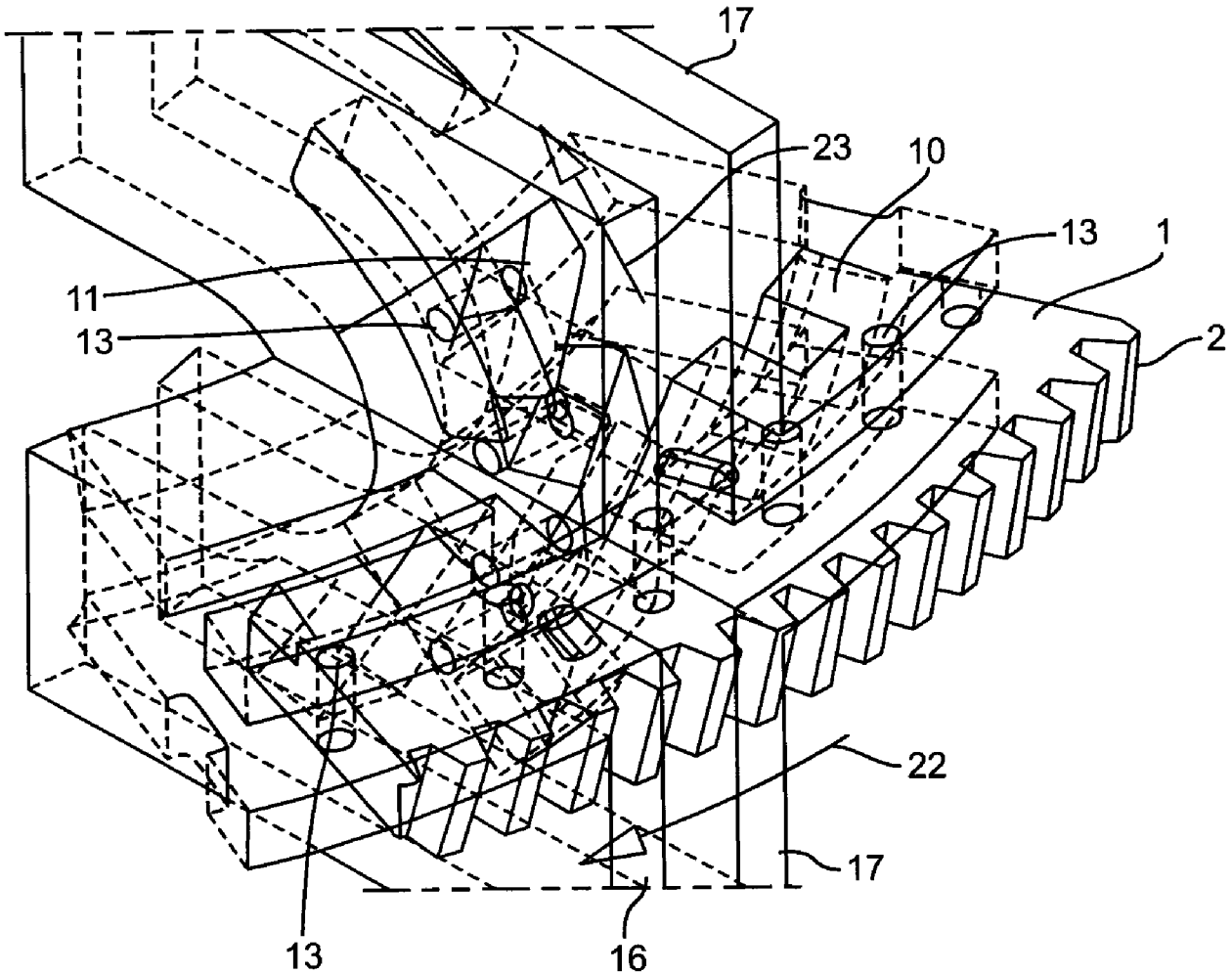
FIG. 3 shows the view according to FIG. 2 in a schematic representation.
Figure 6:
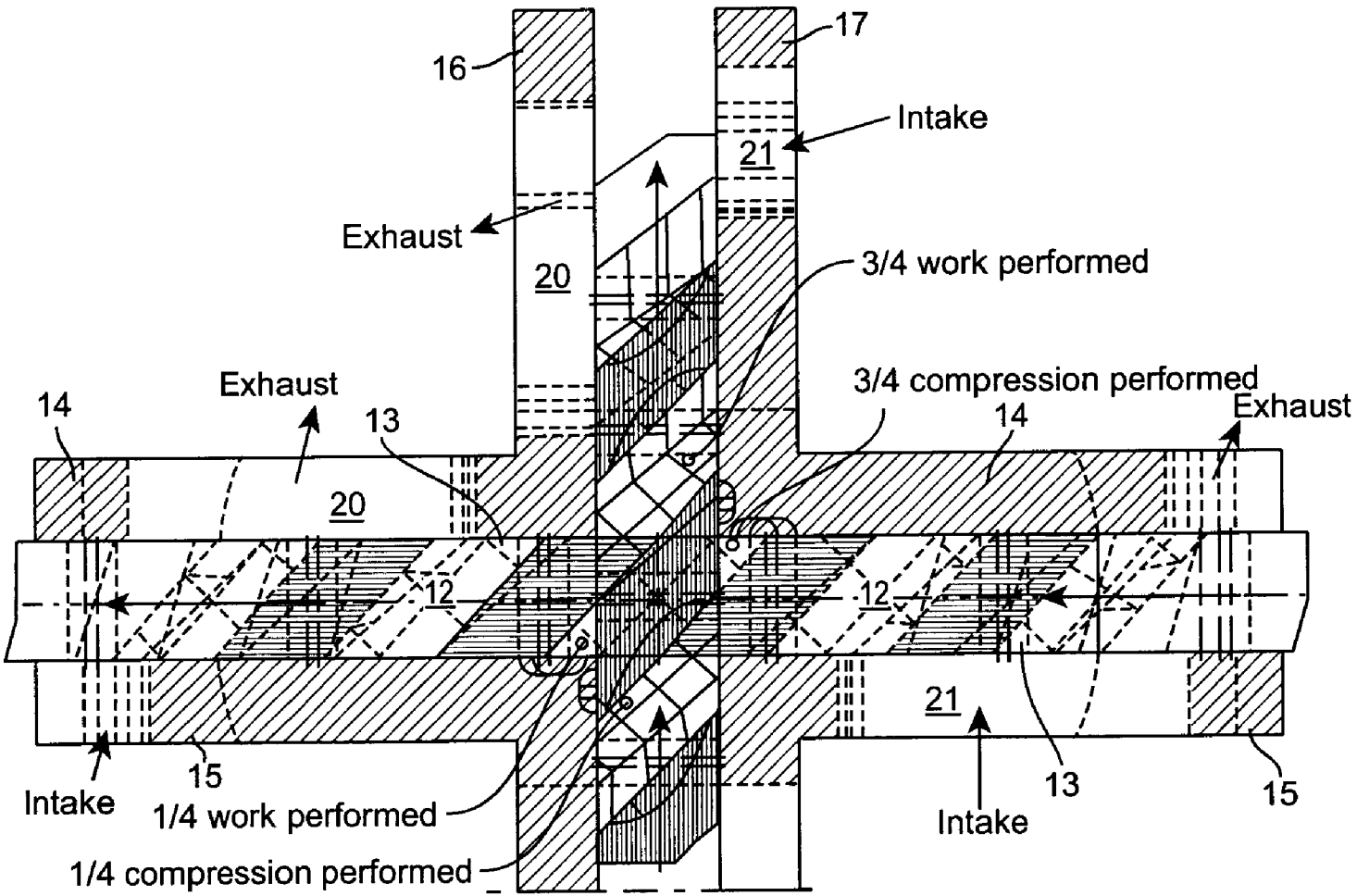
Figure 7:
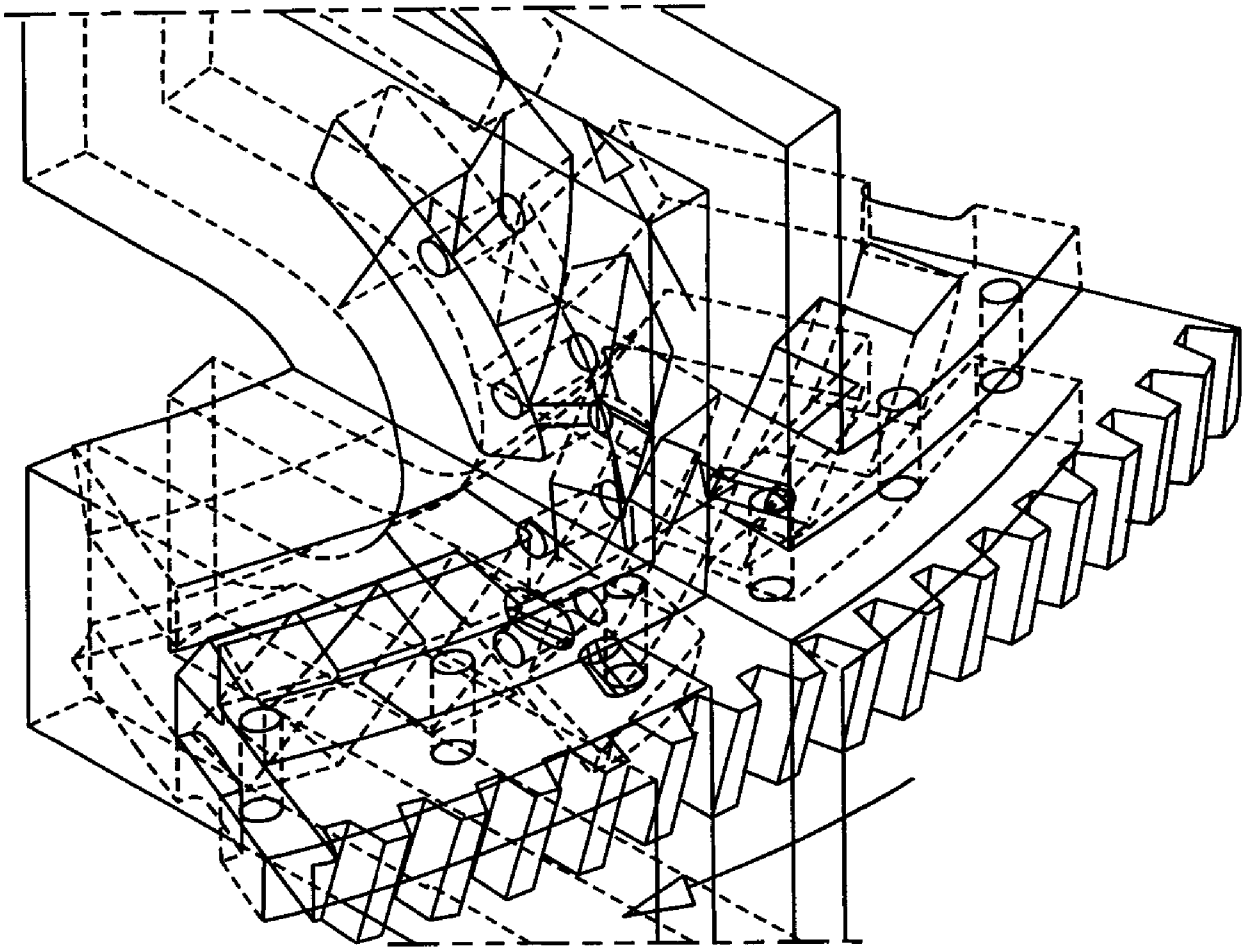
Figure 8:
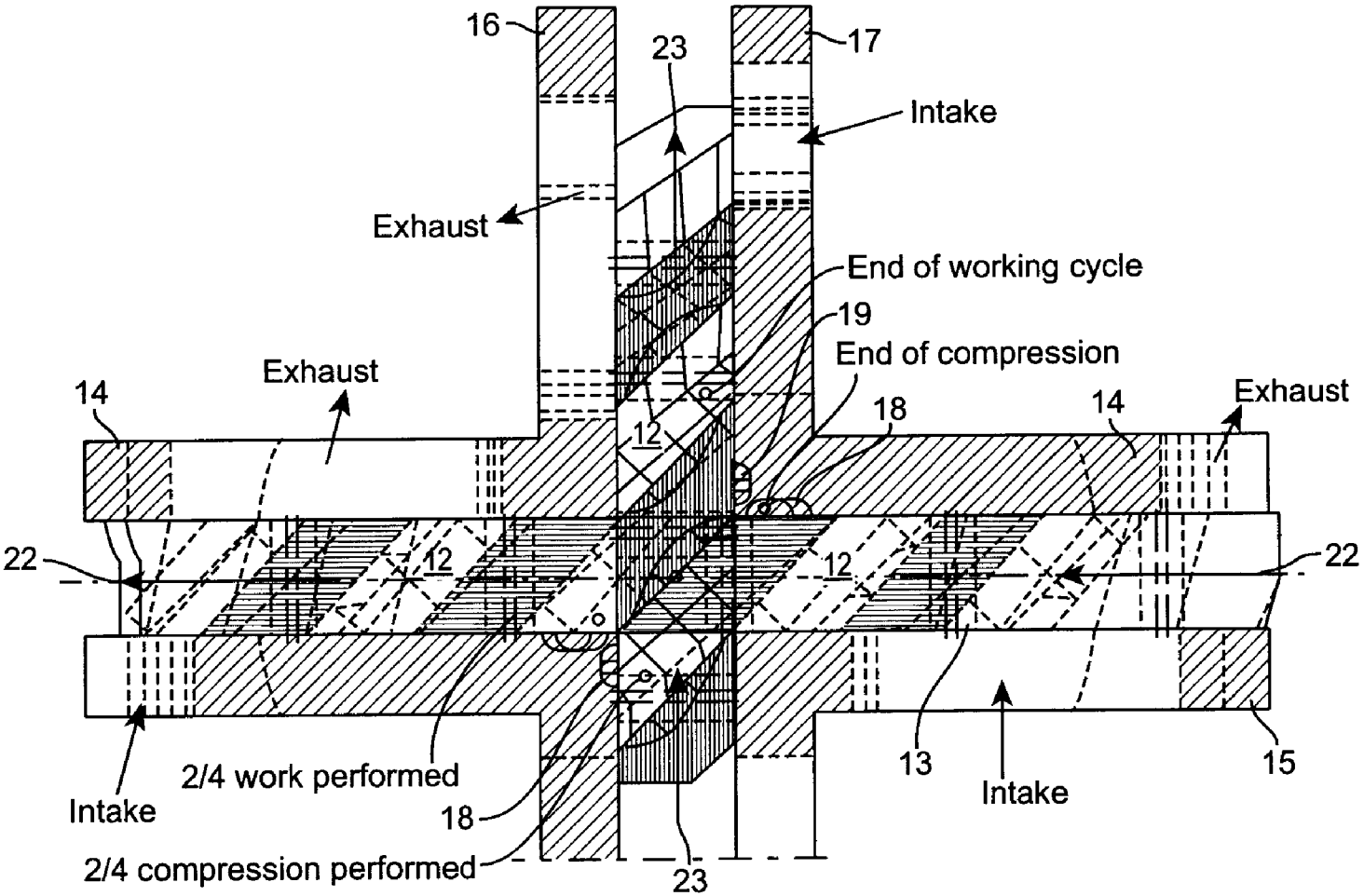
Figure 9:
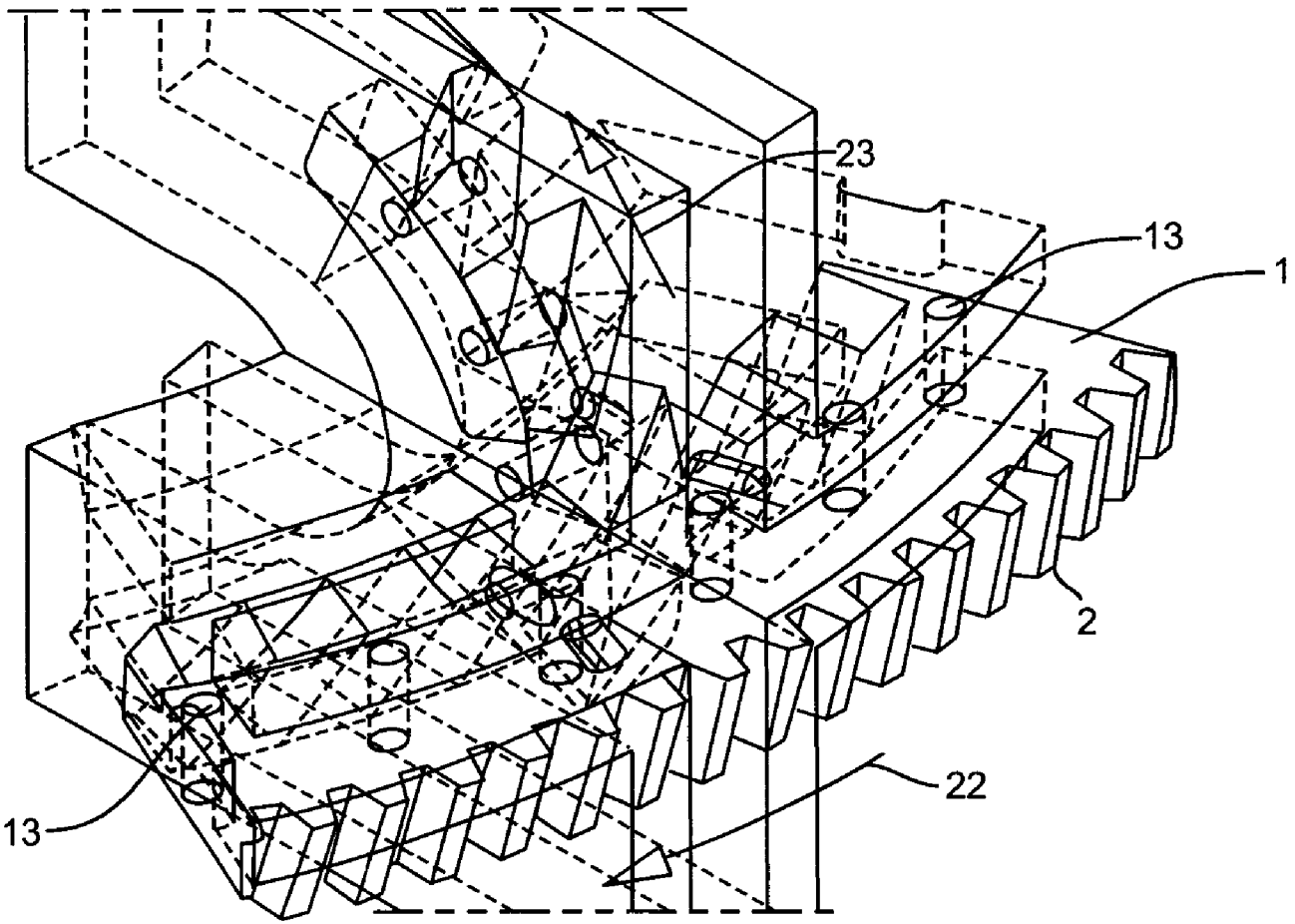

In the position shown according to FIG. 2, the tooth space 12 of internal ring gear 1 shown on the outer right-hand side has already been emptied of the combustion exhaust gas, the latter being slightly pressurized (see "Exhaust" arrow), and has now already been at least partially charged again via the intake opening 21 with combustion air or a fuel mixture (see "Intake" arrow), with the forward tooth space 12 still being supplied with combustion air or a fuel mixture via the intake opening 21. The tooth space 12 seen as the third from the right in FIG. 2 is subjected to increasing compression, the latter being equivalent to ¼ in the position shown in FIG. 2, ⅔ in FIG. 4 and ¾ in FIG. 6. FIG. 8 shows the end of compression or maximum compression for this tooth space 12. The tooth space 12 of internal ring gear 1, having already mostly moved away from the area of tooth engagement point 8, performs ¾ of its work in the position according to FIG. 2, with the end of its working cycle already having been reached in the following position shown in FIG. 4. FIG. 6 then shows for the subsequent tooth space emerging from tooth engagement point 8 the stage of ¼ work performed, and FIG. 8 shows ¾ work performed. It can be seen here in FIG. 6 that a flow connection is established between the throughflow bore 13 located ahead of the tooth engagement point 8 and the first connecting duct 18 indicated in the drawing in housing wall 14, the duct being used as the means through which the throughflow bore 13 is filled from the forward tooth space 12. FIG. 6 shows in a similar fashion that the throughflow bore 13 located to the left of tooth engagement point 8 dissipates pressure via the second connecting duct 19 incorporated in the housing wall 15 into the tooth space just emerging from the tooth engagement area, performing work in the process.

Figure 4:
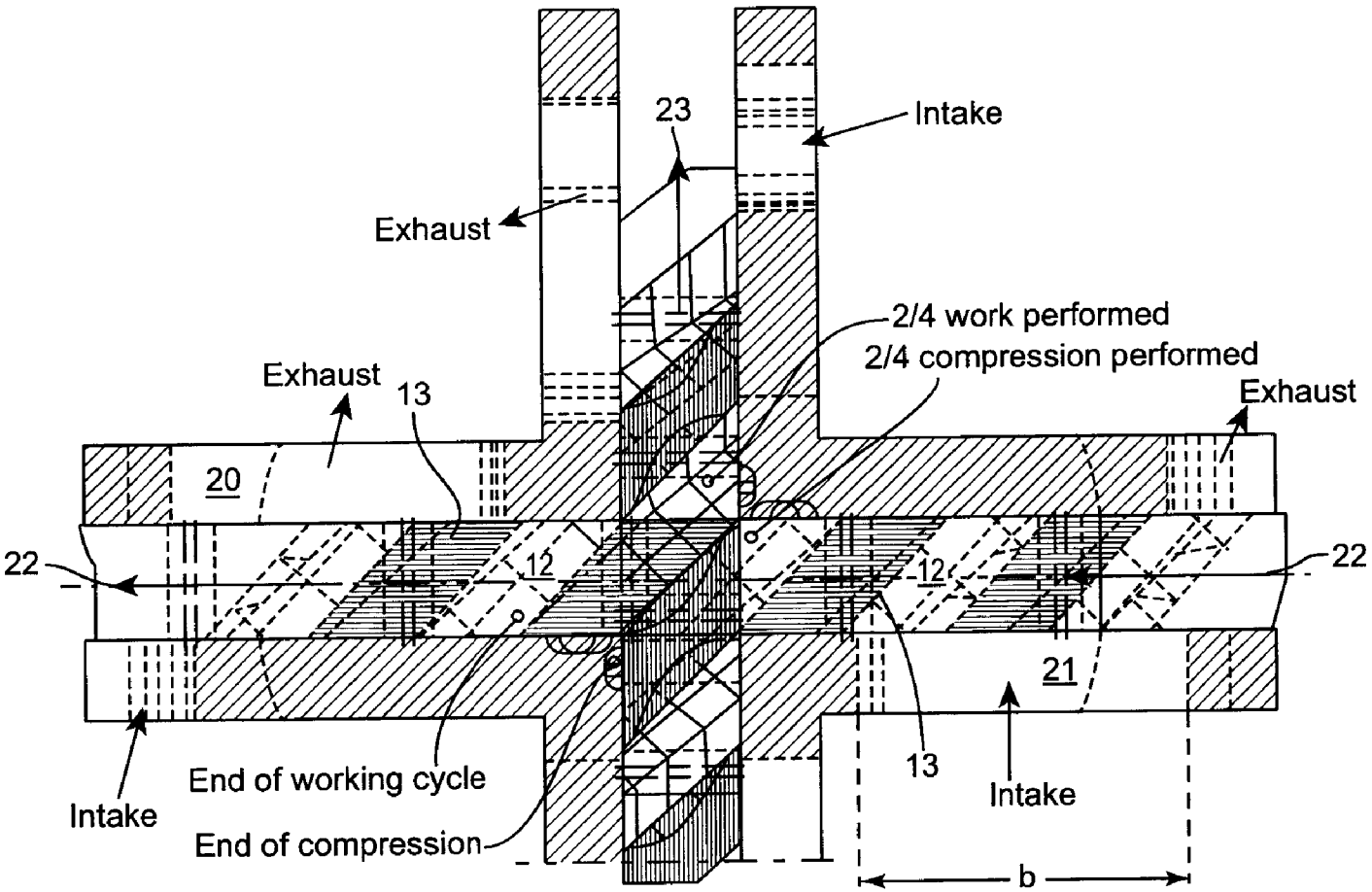
FIGS. 4, 6 and 8 show the three cycles of the work process following the situation illustrated in FIG. 2.
Figure 5:
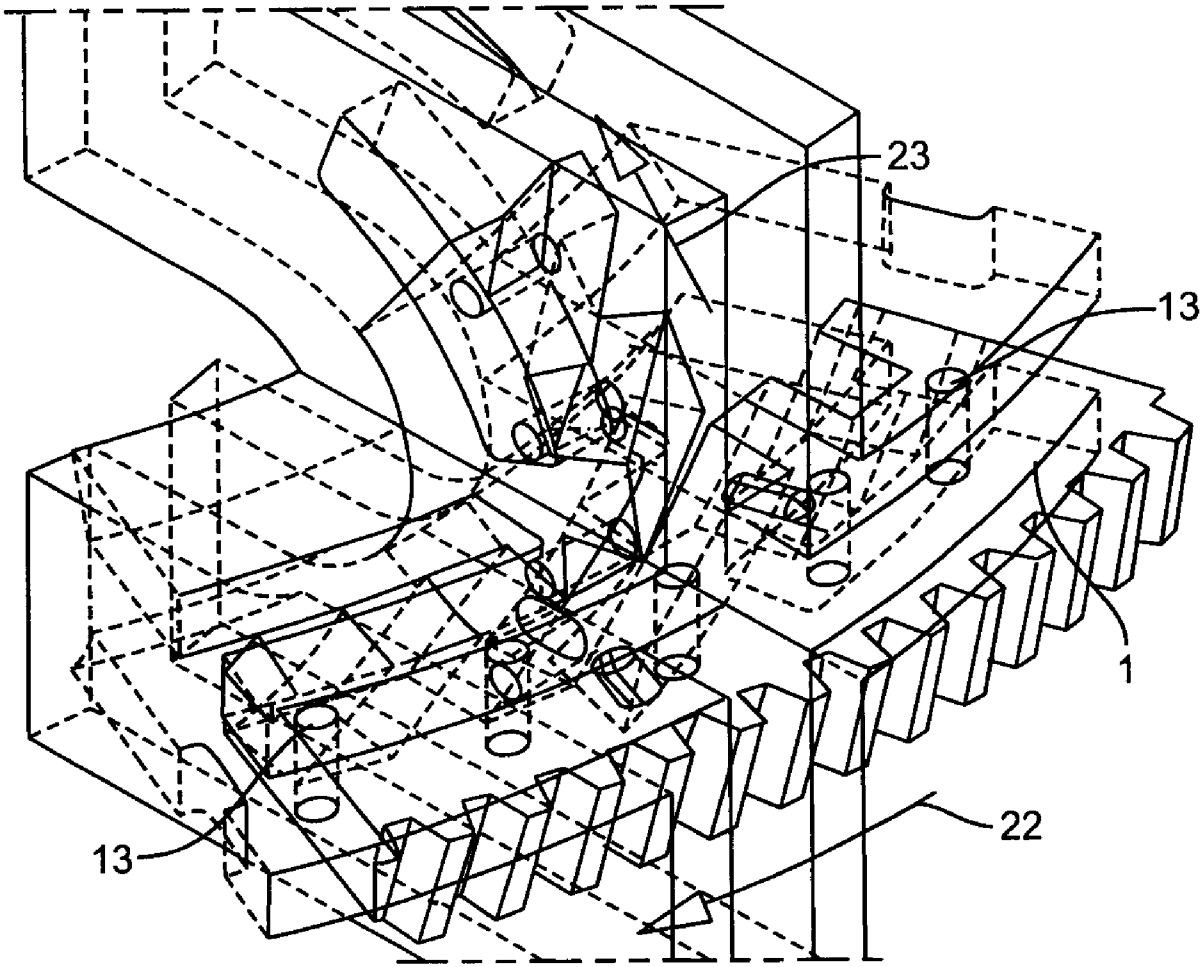
FIGS. 5, 7 and 9 show schematic representations of FIGS. 4, 6 and 8, and FIGS. 10, and 11 show illustrations according to FIGS. 6 and 7 with revised routing of the throughflow bores.

The situation is analogous for rotary piston 7. FIG. 2 shows a compression of ¾ for the tooth space ahead of the tooth engagement point 8, and a performed work of ¼ for the tooth space just emerging from the tooth engagement area 8. FIG. 4 shows the end of compression for the lower tooth space and ¾ work performed for the upper tooth space. According to FIG. 6, the subsequent compression for the following lower tooth space is ¼, and the work performed by the upper tooth space is ¾; in the following cycle illustrated in FIG. 8, the compression in the lower tooth space is ¾, whereas the end of the working cycle is indicated for the upper tooth space, the latter having fully emerged from the tooth engagement area.

The working process thus takes place in a modified 5-stage process:

Stage 1: Exhaust

Stage 2: Intake (it being possible for the exhaust stage and the intake stage to take place dynamically in a single process, as in a 2-stroke engine)

Stage 3: Compression

Stage 4: Vaporization (carburetion and triggering of the combustion process)

Stage 5: Working stage

According to the invention, compressed air or a compressed fuel mixture is pressed through a valveless "window" (first connecting duct 18) into a rotating combustion chamber (throughflow bore 13), where the carbureted fuel mixture is combusted and then displaced in turn through a valveless "window" (second connecting duct 19) into a rotating working volume (tooth space 12). In the process it is possible for the combustion process to be triggered with or without the aid of spark plugs or glow plugs.

What is claimed is:

1. A rotary piston engine having at least two rotary pistons, the at least two rotary pistons being formed as gearwheels, mounted in a rotatable fashion on mutually perpendicular axes in a housing, providing a closed seal for the at least two rotary pistons on both faces as well as around the circumferences, and being at one point in a sliding, mutually sealing engagement of gear teeth (8) with each other, wherein:

a) the at least two rotary pistons have different diameters;

b) internal teeth and external teeth of the at least two rotary pistons contact at an angle of 45° in each case and have slightly helical flanks;

c) tooth spaces, forming a carburetion chamber, a compression chamber, and a working chamber, have an inside contour precisely matching the shape of the teeth;

d) each of the internal teeth and external teeth of the at least two rotary pistons is assigned each of throughflow bores, wherein the latter forming a combustion chamber and being incorporated in the rotary piston, wherein said each of the through-flow bores opens into an outlet on the circular surface areas of the at least two rotary pistons which lie opposite to each other, wherein a closed seal being provided through certain angles of rotation for the bore at points opposing to housing walls which enclose one of the at least two rotary pistons in a sandwich arrangement;

e) ahead of the point in a sliding, mutually sealing engagement of gear teeth, lies a first connecting duct for each of the at least two rotary pistons in the aforementioned housing walls wherein the first connecting duct provides a flow connection between one of the tooth spaces rotating past the first connecting duct 18 and said each of the throughflow bores and fills the latter with compressed air or a fuel mixture;

f) behind the point in a sliding, mutually sealing engagement of gear teeth, lies a second connecting duct for each of the at least two rotary pistons in the aforementioned housing walls wherein the second connecting duct provides a flow connection between the throughflow bores rotating past the second connecting duct and one of the subsequent tooth spaces, into which the charge in said each of the throughflow bores expands;

g) the aforementioned housing walls incorporate exhaust openings both before and after the point in a sliding, mutually sealing engagement of gear teeth as well as intake openings lying opposite to the exhaust openings, wherein the intake openings are connected to an air intake or a fuel mixture intake, and wherein the intake openings are flow-connected in sequence to the tooth spaces passing by, and wherein each of the intake openings overlaps each of the opposite-lying exhaust openings for a partial angle of rotation (a).

2. The rotary piston engine according to claim 1 wherein the intake openings extend across an angular width (b) of more than one tooth space.

3. The rotary piston engine according to claim 1, wherein the throughflow bores forming the combustion chambers are coated with a layer of heat insulating material.

4. The rotary piston engine according to claim 3, wherein the second connecting ducts is also coated with a layer of heat insulating material.

5. The rotary piston engine according to claim 1 wherein the throughflow bores forming the combustion chambers are equipped with catalysts or inserts for flameless combustion.

6. The rotary piston engine according to claim 1 the at least two rotary pistons are each formed as an internal ring gear having a large diameter and enclosing a plurality of the at least two rotary pistons, each being of a smaller diameter and having external toothing, and each being in tooth engagement with the internal ring gear and having their axes of rotation lying in a diametrically symmetrical plane of the internal ring gear, the internal ring gear forming the output of the engine.

7. The rotary piston engine according to claim 6, wherein the internal ring gear has external toothing for the transfer of torque to a transmission connected after the engine.

* * * * *